US009634451B2

(12) United States Patent
Battenfeld

(10) Patent No.: US 9,634,451 B2
(45) Date of Patent: Apr. 25, 2017

(54) CRIMPING PLIERS

(71) Applicant: WEZAG GmbH Werkzeugfabrik, Stadtallendorf (DE)

(72) Inventor: Kurt Battenfeld, Ebsdorfergrund/Wittelsberg (DE)

(73) Assignee: WEZAG GMBH WERKZEUGFABRIK, Stadtallendorf (DE)

( * ) Notice: Subject to any disclaimer, the term of this patent is extended or adjusted under 35 U.S.C. 154(b) by 0 days.

(21) Appl. No.: 14/887,549

(22) Filed: Oct. 20, 2015

(65) Prior Publication Data

US 2016/0111841 A1 Apr. 21, 2016

(30) Foreign Application Priority Data

Oct. 20, 2014 (EP) ..... 14189548

(51) Int. Cl.
*H01R 43/042* (2006.01)
*B21J 7/16* (2006.01)

(52) U.S. Cl.
CPC ..... *H01R 43/042* (2013.01); *B21J 7/16* (2013.01); *H01R 43/0424* (2013.01); *H01R 43/0425* (2013.01)

(58) Field of Classification Search
CPC ..... H01R 49/0428; H01R 43/0424; H01R 43/042; H01R 43/0425; B25B 7/123; B25B 7/06; B25B 7/12; B25B 7/16; B25B 27/146; B21J 7/16
USPC ..... 72/409.14
See application file for complete search history.

(56) References Cited

U.S. PATENT DOCUMENTS 2,079,498 A * 5/1937 Douglas ..... H01R 43/0424 72/402
3,226,968 A * 1/1966 Holmes ..... H01R 43/0424 72/31.04
3,459,029 A * 8/1969 Rosenfeld ..... H01R 43/0424 72/31.12
4,381,661 A 5/1983 Wiener et al.
D341,303 S 11/1993 Davis
5,261,263 A * 11/1993 Whitesell ..... B25B 27/146 29/237

(Continued)

FOREIGN PATENT DOCUMENTS

DE 31 09 289 C2 8/1987
DE 10140270 A1 3/2003

(Continued)

*Primary Examiner* — David B Jones
(74) *Attorney, Agent, or Firm* — Thomas I Horstemeyer, LLP

(57) ABSTRACT

The invention relates to crimping pliers (1). The crimping pliers comprise a spring element (7) which is located in the force flow between hand levers (3, 5) and dies (12). The spring element (7) builds a force-displacement-compensation element (8) which provides the option to be able to crimp workpieces with different cross-sectional areas with the crimping pliers (1). According to the invention, the spring element (7) which builds the force-displacement-compensation element (8) is built in the region of the pliers head (4) of the crimping pliers (1). Preferably, the spring element (7) is a spring in the shape of an arc of a circle or a spiral spring (44) which extends in circumferential direction around the die axis (13).

26 Claims, 23 Drawing Sheets

(56) References Cited

U.S. PATENT DOCUMENTS

| | | | | |
|---|---|---|---|---|
| 5,918,511 | A * | 7/1999 | Sabbaghian | B25B 13/10 81/128 |
| 6,176,116 | B1 | 1/2001 | Wilhelm et al. | |
| 6,889,579 | B1 * | 5/2005 | Brown | B23D 21/06 81/58 |
| 7,997,116 | B2 * | 8/2011 | Norin | B25B 27/10 72/409.08 |
| 8,474,299 | B2 * | 7/2013 | Lutze | H01R 43/0424 72/402 |
| 8,613,210 | B2 * | 12/2013 | Wagner | B25B 27/146 72/20.1 |
| 9,242,349 | B2 * | 1/2016 | Battenfeld | B25B 7/123 |
| 2015/0180190 | A1 | 6/2015 | Dierks et al. | |
| 2015/0217429 | A1 | 8/2015 | Battenfeld | |

FOREIGN PATENT DOCUMENTS

| | | | |
|---|---|---|---|
| DE | 102005003615 | B3 | 9/2006 |
| DE | 20 2009 005811 | U1 | 10/2010 |
| DE | 20 2012 102561 | U1 | 12/2013 |
| DE | 10 2013 100801 | A1 | 7/2014 |
| EP | 0 158 611 | B1 | 7/1990 |
| EP | 0 732 779 | B1 | 2/1996 |
| EP | 2 826 598 | A1 | 7/2013 |
| EP | 2 905 848 | A1 | 2/2014 |
| WO | 2014/114609 | A1 | 7/2014 |

* cited by examiner

CRIMPING PLIERS

CROSS REFERENCE TO RELATED APPLICATIONS

This application claims priority to co-pending European Patent Application No. EP 14 189 548.2 entitled "Presszange", filed Oct. 20, 2014.

FIELD OF THE INVENTION

The invention relates to crimping pliers for crimping a workpiece. This covers any crimping pliers, e.g. crimping pliers for crimping tube connections or wire connections or crimping pliers (also denoted as pressing pliers) for crimping connections of electrical lines or plugs, sleeves, bushings or connectors with any electrical cable. Here the crimping pliers might generally have any of the plurality of available designs and drive mechanisms, wherein during the crimping process the crimping is performed with two or more than two dies or mandrels (in the following together named "dies"). According to the invention, the crimping pliers are actuated by hand forces.

BACKGROUND OF THE INVENTION

During the crimping process of a workpiece the increasing plastical deformation of the workpiece between the dies requires a crimping force which increases during the crimping process. For known crimping pliers the hand forces manually applied upon hand levers of the crimping pliers are transmitted to the dies by a drive mechanism such that it is possible to generate the required maximal crimping forces by manual actuation of the hand levers. Generally for the known crimping pliers the force flow was provided by rigid components of the crimping pliers.

It is intended that it is not only possible to use crimping pliers for crimping of workpieces with one single geometry, one single material stiffness and/or one single cross-sectional area (in the following together simplified as "cross-sectional area") but to use the crimping pliers in a multi-functional way also for different workpieces with differing cross-sectional areas. However, in the case of a rigid design of the components of the crimping pliers, the crimping pliers are designed for crimping a workpiece with a specific cross-sectional area. The use of the crimping pliers for a workpiece with a smaller cross-sectional area has the consequence that for this use the required maximal crimping forces will not be reached, whereas for the use of the crimping pliers for workpieces with larger cross-sectional areas the maximum crimping forces are already produced after a part of the stroke of the hand levers so that the complete closure of the hand levers would result in excess crimping forces or the complete closing of the hand levers is not possible by manual actuating forces. A remedy was in the past only provided by providing the crimping pliers with exchange heads or exchangeable dies for the specific differing cross-sectional areas of the workpieces.

According to the post-published European patent application EP 2 826 598 A1 it is proposed to equip a crimping tool with a drive mechanism which comprises a mechanical limiting device for limiting the crimping force. The mechanical limiting device for limiting the crimping force limits the crimping force generated by the crimping tool to a predetermined desired crimping force independent on the size of the crimping stroke. With a limiting device for limiting the crimping force of this type it is generally possible to dimension the drive mechanism of the crimping tool such that when crimping a workpiece with a smaller cross-sectional area the required crimping force is achieved. If in a crimping tool of this type workpieces with larger cross-sectional areas are used excess crimping forces or excess actuation forces are avoided by triggering the mechanical limiting device for limiting the crimping force. However, the mechanical limiting device for limiting the crimping force drastically increases the design complexity.

Further known embodiments of crimping pliers base on the principle that an undesired increase of the manual actuation force and the maximal crimping force at the dies can be reduced or avoided if the drive mechanism is not equipped with rigid components but instead purposeful is provided with an elasticity in the drive mechanism. When crimping a workpiece with a cross-sectional surface being too large any elasticity in the drive mechanism not (only) leads to a plastic deformation of the workpiece but the drive mechanism also gives way which is due to the elastic component so that in the ideal case without any further plastic deformation of the workpiece the hand levers can be closed only under an elastic deformation of the drive mechanism. Embodiments basing upon this principle are known from the following publications:

The publication EP 0 732 779 B1 discloses crimping pliers for crimping wire end sleeves with an electrical wire with removed insulation. The crimping pliers comprise a pliers head. The pliers head is built with a base body. The base body is rigidly connected to a fixed hand lever. A pivot ring is pivotable around a die axis relative to the base body. In the region of its inner surface the pivot ring comprises radial recesses so that a kind of spline shaft profile is built. Six crimping plungers are evenly distributed located around the die axis. The crimping plungers are mounted for being pivoted at a pivot bolt held by the base body. In the end region facing away from the die, the crimping plungers are each accommodated in a spline shaft type recess of the pivot ring. The rotation of the pivot ring leads to a common pivoting movement of the crimping plungers. The die surfaces of the crimping plungers located at the radial inner side build a die contour which is almost closed in circumferential direction. The cross-sectional area of the die contour decreases with the pivoting movement of the pivot ring and the coinciding pivoting movement of the crimping plungers which leads to the crimping of the wire end sleeve. The actuation of the pliers head by achieving a relative pivoting movement of the pivot ring relative to the base body is achieved by a drive bolt or pivot bolt which is linked to the pivot ring. The drive bolt or pivot bolt is a component of a pivot bearing by which one end region of a movable hand lever is linked to the pivot ring. By another pivot bearing slightly distant from the aforementioned pivot bearing a pressure lever is linked to the movable hand lever, wherein this pivot bearing builds a toggle lever joint. In the end region facing away from the toggle lever joint the pressure lever is linked to the fixed hand lever. For this purpose the pressure lever builds a bearing sphere which is housed in a bearing shell built by the fixed hand lever. A return spring acting in opening direction of the crimping pliers is directly linked with one spring base to the pivot ring, whereas the other spring base of the return spring is linked to the fixed hand lever. Remote from the connecting region between the toggle lever joint and the bearing sphere the pressure lever comprises a part of its circumference which is comprises a toothing which cooperates with a latching element. The latching element is mounted for being pivoted to the movable hand lever and is biased into an equilibrium position by a spring which acts between the latching element and the movable hand lever. A forced locking unit is built with the toothing of the pressure lever and the latching element. It is intended that the forced locking unit provides that a crimping step of the crimping pliers once reached will also be secured when reducing the actuation forces applied to the hand levers without any opening movement of the pliers head being possible. Instead, an opening movement is only possible if the pressure lever has passed the complete predetermined working stroke. The publication EP 0 732 779 B1 describes the problem that generally for crimping pliers with a forced locking unit by the forced locking unit an end position is defined which correlates with a predetermined end size of the die contour. When crimping workpieces of different sizes (e.g. due to tolerances during the manufacturing process of the workpiece or due to the use of different types of workpieces) with the crimping pliers, it is necessary to perform the crimping process until the aforementioned end size of the die contour has been reached. Accordingly, the working stroke will always be the same independent on the size of the workpiece, whereas the effective crimping forces depend on the size of the workpiece. This might in some cases deteriorate the uniformity and quality of the crimping results. It is also possible that damages and in the worst case failure of components of the crimping pliers occur due to an overload of the same. On this background the publication EP 0 732 779 B1 proposes not to support the ball pin of the pressure lever in a rigid fashion. Instead, according to the publication EP 0 732 779 B1 the fixed hand lever is elastically in the connecting region between the base body and the bearing shell. Dependent on the magnitude of the applied crimping force the bearing shell is able to elastically deflect. The deflection of the bearing shell allows a movement of the hand levers towards each other without any pivoting movement of the pivot ring relative to the base body and so without any further reduction of the cross-sectional area of the die contour. Accordingly for a larger workpiece, according to publication EP 0 732 779 B1 it is possible to reach the end position of the forced locking unit by in the beginning in a crimping stroke moving the crimping plungers towards each other with an extent of the movement which is smaller than the extent of the movement of the crimping plungers towards each other for a smaller workpiece. Then, a further movement of the hand levers towards each other does not lead to a further movement of the crimping plungers towards each other but to an elastic deformation of the fixed hand lever. Also possible is a superposition of the movement of the crimping plunger and the deformation of the fixed hand lever. In order to provide an elasticity of sufficient amount for the support of the bearing shell, the fixed hand lever is built with two hand lever parts which are connected to each other in an end region in a V-shape. In another end region one hand lever part forms the bearing shell, whereas the end region of the other hand lever part is rigidly connected to the base body of the pliers head or builds the same. Both of the hand lever parts are elastic. For this purpose, the hand lever part forming the bearing shell is tapered towards the bearing shell, whereas the other hand lever part comprises a narrowing with an extent of the narrowing that it is possible to elastically deform this hand lever part with the applied hand forces. The rigid connecting region of the two V-shaped hand lever parts has to be designed such that in this connecting region the actuation of the crimping pliers is still possible by the hand of the user. According to the publication EP 0 732 779 B1 the connection of the two hand lever parts is provided by a form-locking connection by transverse bolts and burls embossed in longitudinal direction. In the publication EP 0 732 779 B1 the effect achieved by the elastic support of the pressure lever in the region of the bearing shell is denoted as a "force-displacement-compensation".

Also EP 0 158 611 B1 proposes to support the linking point of the pressure lever at the fixed hand lever in an elastic fashion. This is here done by locating a bearing bolt held by the pressure lever in an elongated hole of the fixed hand lever, wherein it is possible that the bearing bolt moves along the elongated hole under the bias of a spiral spring.

DE 31 09 289 C2 also suggests to elastically support a pressure lever (here for crimping pliers with scissor-like crimping jaws). In this case, the elastic support of the pressure lever is provided by equipping the hand lever in the region of the linking point for the pressure lever with a narrowing in the shape of a slit which leads to a bifurcation of the fixed hand lever with a reduction of the material cross-section of the fixed hand lever in the region of the bifurcation. For the applied crimping forces the reduction of the material cross-section leads to an elastic deformation of the fixed hand lever.

The post-published European patent application EP 2 905 848 A1 relates to crimping pliers, wherein the drive mechanism is built by a toggle lever mechanism. Here, the elasticity of the drive mechanism is not provided in the region of the bearing of the pressure lever but in the pressure lever itself. For this purpose, the pressure lever is curved or cranked and flexible for bending.

DE 20 2012 102 561 U1 discloses crimping pliers, wherein a fixed hand lever supports base metal sheets located on both sides of the pliers head. By a toggle lever drive actuated by a movable hand lever it is possible to manually rotate a sliding piece plate building a first actuation element. Crimping plugs are both supported at bearing locations at the base metal sheet building the other actuation element as well as guided in the sliding piece plate. Accordingly by a relative rotation of the sliding piece plate relative to the base metal sheets due to the actuation of the toggle lever drive it is possible to crimp the workpiece between the crimping plugs. The free end region of one toggle lever of the toggle lever drive is linked to the sliding piece plate. The free end region of the other toggle lever of the toggle lever drive is elastically supported at a curved spring arm built by the base metal sheet. Accordingly, the embodiment of DE 20 2012 102 561 U1 generally corresponds to the embodiments of EP 0 158 611 B1 and DE 31 09 289 C2 with the elastic design of a linking point of the pressure lever or toggle lever.

According to DE 20 2009 005 811 U1 disc-like actuation elements being rotatable relative to each other used for actuating the crimping plugs are each rigidly mounted to an associated hand lever, wherein an actuation element is built by an elastic spring arm.

Also DE 10 2013 100 801 A1 discloses the elastic support of a pressure lever at a spring arm built by the fixed hand lever.

U.S. Pat. No. D341,303 discloses crimping pliers for crimping tube connections, wherein a toggle lever drive is used having a design with a roller and a guiding part along which the roller rolls during the working stroke.

SUMMARY OF THE INVENTION

The inventive crimping pliers comprise two drive elements. In the case that the crimping pliers are manually actuated crimping pliers, the drive elements might be hand levers or components coupled to the hand levers. The inventive crimping pliers furthermore have a pliers head. Actuation elements are located in the region of the pliers head. The actuation elements actuate the dies between which the workpiece is crimped. It is possible that the actuation elements are rigidly (but also exchangeably) coupled to the dies or directly cooperate with the same (cp. the publications EP 0 732 779 B1, DE 101 40 270 B4 and DE 10 2005 003 615 B3, in which an actuation element is built by a pivot ring, wherein counter-contact surfaces of the dies contact contact surfaces of the pivot ring and wherein a pivoting movement of the pivot ring results in the movement of the dies).

With the novel crimping pliers, it is possible to provide an alternative and/or improved embodiment of crimping pliers which can be used for crimping workpieces with different cross-sectional areas. It is in particular the object of the invention to provide the crimping pliers with an alternative or improved force-displacement-compensation element.

According to the invention in the crimping pliers a spring element is provided. The spring element is located in the force flow between the drive elements and the dies. The spring element builds a force-displacement-compensation element. Within the frame of the invention a force-displacement-compensation element is in particular a spring element which for a blocking of the closing movement of the dies (in particular with a workpiece with a cross-section being too large or a rigid test body) permits a closing or movement of the drive elements of at least 10% (e.g. at least 20%, 30%, 50% or 70% or 100%) of the whole working stroke of the drive elements with drive forces applicable to the drive elements (so the maximal force of an external force actuated drive or the maximal hand force). By use of a force-displacement-compensation element of this type the field of application of the crimping pliers for crimping workpieces with differing cross-sectional areas can be extended. For the embodiments known from the prior art, the spring element which builds the force-displacement-compensation element is located in the region of the hand levers or of the toggle lever mechanism: According to the publication EP 0 732 779 B1 both a hand lever as well as a supporting arm for a toggle lever is elastic. The publications EP 0 158 611 B1 and DE 31 09 289 C2 suggest an elastic design of a linking point of the pressure lever, whereas the post-published European patent application EP 2 905 848 A1 proposes an elastic design of the pressure lever. According to the invention it has for the first time been found that there is an alternative or cumulative location for the arrangement of the force-displacement-compensation element and/or an alternative or cumulative component for the provision of the spring element building the force-displacement-compensation element: The invention proposes that the spring element which builds the force-displacement-compensation element is formed or located in the region of the pliers head. Here, the force-displacement-compensation element might e.g. be integrated into a kind of housing of the pliers head, where it is only partially or not visible from the outside. In the case that the pliers head is built in a plate design, the spring element which builds the force-displacement-compensation element might at least partially be located between the cover plates of the pliers head.

For one embodiment of the inventive crimping pliers, a drive mechanism of any design is present which is interposed between the drive elements and the actuation elements. To name only one example, the drive mechanism might be formed by a toggle lever mechanism. For this proposal the spring element which builds the force-displacement-compensation element is interposed in the force flow between the drive mechanism and the actuation elements. Said in different words, the spring element is located downstream in the force flow between the drive mechanism, wherein then for the design of the drive mechanism as a toggle lever mechanism the spring element is not a component of the toggle lever mechanism.

The spring element which is integrated into the pliers head and which builds the force-displacement-compensation element might be coupled in any way with the other components of the crimping pliers, e.g. might be integrally built with another component or might be connected to the same with a plurality of parts, might be linked at the same in the region of the spring base or might be guided in the region of a spring base or in any region of the spring element. For one embodiment of the inventive crimping pliers the spring base of the spring element is fixed at the actuation element. This also covers an integral formation of the spring element with this actuation element. The spring base of the spring element might e.g. be fixed at the actuation element built by a pivot ring.

For the design of the spring element building the force-displacement-compensation element there are a lot of options. The spring element might be built by a compression spring or a tension spring. For one particular proposal of the invention, the spring element is built by a bending beam. Here the bending beam might have any geometry, e.g. with a straight or curved or bent design. By choice of the curvature of a neutral fiber of the bending beam, of the material of the spring element and of the bending stiffness, in particular the geometrical moment of inertia, it is possible to specifically influence the elasticity of the spring element and the deformation characteristic of the spring element.

For a particular embodiment of this idea, the spring element built by a bending beam has a plate design. The plate design permits a very simple production of the spring element. Dependent on the design of the single plates of the spring element, it is possible to specifically define and to define with a high accuracy the elastical behavior of the spring element. It is even possible that crimping pliers with different characteristics of the force-displacement-compensation element are provided by using a different number of plates, the plates being identical for the different spring elements except the number of plates used. In some cases, a plate design is also advantageous if the spring element is built integrally with another component of the crimping pliers, in particular an actuation element or the pivot ring, so that both a production of the spring element as well as of the other component can be done with one and the same plate and the manufacturing method used therefore.

Another embodiment of the invention addresses the integration of the spring element into the pliers head. For this embodiment it is proposed that the spring element (at least partially) extends in circumferential direction around a die axis. Here, it is possible that the spring element extends with a circumferential angle of e.g. more than 90°, more than 180° or even more than 270° around the die axis. It is possible that the spring element extends in circumferential direction with a plurality of straight partial regions being inclined one against the other. However, any curved extension of the spring element in circumferential direction is also possible.

For a preferred embodiment of the invention, the spring element is formed by a spring having the shape of an arc of a circle or by a spiral spring. For such a spring with the shape of an arc of a circle or spiral spring an advantageous characteristic of the spring element results. In some cases also large spring displacements are possible. It is also possible that by a spring element of this type an elasticity is provided which is both effective in circumferential direction about the die axis as well as in a direction radial to the die axis. This might be in particular advantageous for the integration of the spring element into the force flow between the drive elements, the drive mechanism and the actuation elements or dies.

In the case that the spring element has the design of a bending beam, the progression of the bending stiffness along the longitudinal axis of the bending beam is arbitrary. For a preferred embodiment of the invention, the bending beam has a bending stiffness which varies along its (straight or curved) longitudinal axis. For a particular embodiment of the crimping pliers, the geometric moment of inertia of the bending beam increases from the spring base at which the spring is biased by the drive mechanism to a cross-section of the bending beam located opposite in circumferential direction to this spring base, wherein the increase might progress continuously or in steps. For another embodiment of the inventive crimping pliers, the geometric moment of inertia of the bending beam is symmetrical to a symmetry axis. The symmetry axis runs approximately or exactly through the spring base at which the spring is biased by the drive mechanism and runs through the cross-section of the bending beam which is located opposite to this spring base in circumferential direction. Here, the die axis is preferably located on the afore mentioned symmetry axis. An embodiment of this type has proven to be particularly advantageous for the design of tensions in the bending beam and/or for the symmetrical force generation in the actuation element which is coupled to the bending beam.

As explained above, it is possible that the dies are directly mounted and fixed at an actuation element. For another embodiment of the invention, the actuation element comprises guidances for the dies. The other actuation element comprises actuating surfaces for the dies. In this case, a relative movement of the actuation elements causes a movement of the dies relative to the guidances which is caused by the contact of the actuation surfaces with the dies. In this context there is preferably both a sliding movement of the dies relative to the guidances of the one actuation element as well as a sliding and/or rolling movement of the dies relative to the actuation surfaces of the other actuation element.

It is also possible that the actuation elements are pivoted relatively to each other about the die axis. In this case an actuation element is e.g. built by a pivot ring. In this case it is possible that the dies are pivotably mounted to the guidances, in particular by a bearing bolt which is held at the pliers head and supports or bears the dies with a bearing axis which is fixed with respect to the pliers head. The relative pivoting movement of the actuation elements results in a pivoting movement of the dies relative to the guidances. This pivoting movement of the dies is caused by the contact of the actuation surfaces of the actuation element with the dies.

Whereas generally any design of the drive mechanism is possible, the drive mechanism is preferably built by a toggle lever mechanism.

Here, the end regions of the toggle levers facing away from a toggle lever joint of the toggle lever mechanism might be mounted to a fixed bearing location (e.g. to a drive element as a hand lever and/or to an actuation element as a pivot ring). In this case, the effective lengths of the toggle levers and the movement of the toggle levers over the working stroke of the toggle lever mechanism is defined by the design.

For another embodiment, the invention proposes that the toggle lever mechanism is built by a roller and a guiding part. Over the working stroke the roller rolls along the guiding part. Within the frame of the invention the rolling movement between the roller and the guiding part might on the one hand be caused by the closure of the dies with the crimping process of the workpiece and on the other hand by an elastic deformation of the force-displacement-compensation element built by the spring element. By the choice of the diameter of the roller, by the choice of the shape of the curved track of the guiding part and by the choice of the components and location where the roller and the guiding part are located there is provided another option for influencing the characteristic of the drive mechanism.

Whereas it is generally possible to locate the guiding part and the roller at any component and any drive element for one embodiment the invention suggests that the guiding part is fixed at the drive element at which the actuation element is fixed. For one example, the drive element at which the guiding part is fixed is the hand lever which is rigidly connected to the actuation element. Instead, for this embodiment the roller is mounted for being rotated to the other drive element (in particular to the hand lever linked for being pivoted at the actuation element). This design has the consequence that by means of the rolling movement of the roller along the guiding part it is possible to change a toggle lever angle of the toggle lever mechanism. By suitable choice of the curved track of the guiding part it is possible to define the toggle lever angle which fulfills the requirements at any point over the working stroke. It can e.g. be tried to provide that due to the rolling movement of the roller along the curved track of the guiding part the toggle lever angle remains in a certain angular region (e.g. from 130° to 180°, in particular 145° to 180°) which is the case independent on the workpiece which is to be crimped.

It is possible that the force conditions of the crimping pliers for the crimping process of the workpiece can only be influenced by one single spring element, which builds the force-displacement-compensation element. For another embodiment of the invention, it is proposed that another spring element is provided which provides a pressing force for pressing the roller to the curved track of the guiding part. This also covers embodiments wherein by the additional spring element a pressing force of the roller to the curved track is added additional to other means providing the pressing force.

Here it is possible that a spring base of the other spring element directly biases the spring element which builds the force-displacement-compensation element.

For another embodiment, the invention suggests that the crimping pliers are built with a forced locking unit. A forced locking unit of this type is understood to be a latching mechanism which on the one hand side secures a partial crimping step once reached when passing the working stroke of the crimping pliers against an opening movement. On the other hand, the forced locking unit only permits the opening movement of the crimping pliers if the working stroke of the crimping pliers has been completed. By use of a forced locking unit it is possible to provide the process security by on the one hand providing the option to change the gripping of the crimping pliers during the working stroke with a temporal release of the forces applied to the hand levers with the simultaneous securing of the partial crimping step by the forced locking unit. On the other hand, it can be avoided that the crimping pliers are again opened and the workpiece is removed from the crimping pliers before the working stroke has been completed and before workpiece has been crimped in the right way.

For another embodiment, the invention proposes that the forced locking unit is built with a toothed latching lever. The toothed latching lever is mounted for being rotated along the rotational axis of the roller. Remote from the rotational axis of the toothed latching lever the builds two lever parts. An outer end region of one lever part builds the toothing for latching of the forced locking unit. The outer end region of the other lever part is connected by an elongated hole with the drive element at which the guiding part is mounted. By this elongated hole (which might comprise any contour) despite of the coupling of the rotational axis of the toothed latching lever by the roller and the guiding part with the drive element a linking of the end region of the toothed latching lever equipped with the elongated hole to the drive element is made possible.

Generally, the crimping pliers might also be used only for one type, one geometry and/or one cross-sectional area of the workpiece. In a preferred embodiment of the invention, it is possible to crimp workpieces of differing cross-sectional areas to be crimped with the crimping pliers by use of the force-displacement-compensation due to the force-displacement-compensation element and/or by use of the movement of the roller along the curved track with a change of the sizes and angles of the toggle lever mechanism. Here, it is possible that the cross-sectional areas of different workpieces which can be crimped with one and the same crimping pliers (without an exchange of an exchange head or an exchange of dies) might differ from each other by a factor of at least 30 (in particular a factor of at least 45, 50, 75, 100, 115 or even 200). In order to mention one example, it might be possible to crimp workpieces with a cross-sectional area of 0.08 $mm^2$, 0.14 $mm^2$, 0.25 $mm^2$, 0.35 $mm^2$, 0.5 $mm^2$, 0.75 $mm^2$, 1.0 $mm^2$, 1.5 $mm^2$, 2.5 $mm^2$, 4 $mm^2$, 6 $mm^2$, 10 $mm^2$ and 16 $mm^2$ with one and the same crimping pliers.

In the opening position of the crimping pliers, the dies build an accommodation for the workpiece which has to be at least as large as the largest workpiece which is to be crimped with the crimping pliers. The smaller the workpiece is which is actually inserted into the accommodation built by the dies in the opening state, the larger is the play and the worse is the guidance and fixation of the workpiece in the pliers head in the opening state. In order to provide an accommodation and exact orientation of the smaller workpiece in the crimping pliers at the beginning of the crimping process itself, it would be necessary to provide a partial closing movement and a fixation of the drive elements such that the accommodation built by the dies is made smaller to an extent such that the smaller workpiece is accommodated with a close fit. For an alternative or cumulative embodiment, the invention proposes that a positioning device is located at the pliers head. By the positioning device a workpiece with a predetermined cross-sectional area is held in an accommodation (preferably also workpieces with differing cross-sectional areas in a plurality of accommodations) in a predefined position and orientation at the pliers head before the crimping process starts. Here, the positioning device is preferably only equipped with suitable accommodations for a part of the different workpieces which will be crimped with the pliers and for a part of the different cross-sectional areas.

For a particular proposal of the invention, the invention proposes to guide the spring element by a guidance. The guidance is preferably a guidance which is additional to other couplings of the spring element with the adjacent components of the crimping pliers. So, the guidance is in particular additional to the drive connection of the spring element with the actuation element and additional to the coupling of the spring element in the region of the other spring base with the drive element or hand lever. Here, the additional guidance might be provided in the region of the spring base or at any other place of the spring element between the spring bases. The guidance might permanently or only temporarily during a part of the working stroke be effective. By means of the guidance, it is possible to provide a guidance of the spring element in circumferential direction around the die axis and/or radially to the die axis. It is also possible that in the guidance the spring element is biased under a pretension against a protrusion or step or shoulder or into an end position. Only when overcoming the pretension during the travel through a part of the working stroke of the crimping pliers, the spring element might be released and accordingly a movement along the guidance takes place. For this design, the spring element might be equipped with a specific "non-linearity" because with the release of the spring element from the protrusion or step or shoulder the boundary conditions for the elastic deformation of the spring element change. Here, it is possible that the guidance is e.g. provided by a housing or a cover plate of the pliers head. However, it is also possible that the guidance of the spring element is provided by a component of the crimping pliers which is moved during the working stroke. For a specific embodiment of the invention, the guidance is provided in the region of the spring element with respect to another region of the spring element.

Advantageous developments of the invention result from the claims, the description and the drawings. The advantages of features and of combinations of a plurality of features mentioned at the beginning of the description only serve as examples and may be used alternatively or cumulatively without the necessity of embodiments according to the invention having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the invention or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the invention do not have the features mentioned in the claims.

The number of the features mentioned in the claims and in the description is to be understood to cover this exact number and a greater number than the mentioned number without having to explicitly use the adverb "at least". For example, if an element is mentioned, this is to be understood such that there is exactly one element or there are two elements or more elements. Additional features may be added to these features, or these features may be the only features of the respective product.

The reference signs contained in the claims are not limiting the extent of the matter protected by the claims. Their sole function is to make the claims easier to understand.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

FIGS. 12 to 13 show a different embodiment of the crimping pliers wherein FIG. 12 shows the toggle lever angle of the toggle lever mechanism in an open position and FIG. 13 shows the toggle lever angle of the toggle lever mechanism in the closed position.

DETAILED DESCRIPTION

Figure 1:
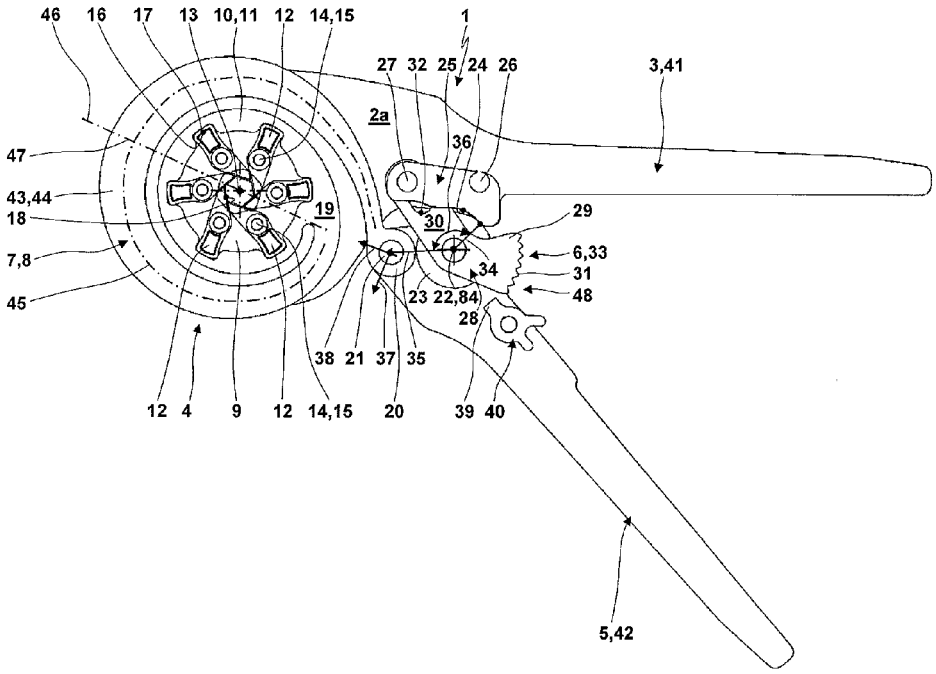
FIGS. 1 to 11 show a first embodiment of the crimping pliers in an open position (FIG. 1), a closed position (FIG. 2), with components of the crimping pliers in an exploded view (FIGS. 3 and 4), with a guiding part with curved tracks in a three-dimensional single part drawing (FIG. 5), with a toggle lever angle of the crimping pliers in the open position (FIG. 6) and in the closed position (FIG. 7) and with the actuating force curves for different workpieces (FIG. 8) and with the dimensions of the spring element (FIGS. 9 and 10) and with the resulting curves for the tension in the spring element (FIG. 11).

FIG. 1 shows crimping pliers 1 in an illustration wherein one of two cover plates 2*a*, 2*b* with which a fixed hand lever 3 and a pliers head 4, in particular in a kind of "housing" of the pliers head 4, is built, is disassembled.

The crimping pliers 1 are built with a fixed hand lever 3 and a movable hand lever 5. A pivoting of the hand levers 3, 5 towards each other (cp. the transition from FIG. 1 to FIG. 2) via a drive mechanism 6 and a spring element 7, which builds a force-displacement-compensation element 8 generates a relative movement of actuation elements 9, 10. Here, the actuation element 9 is integrally built by the part of the cover plate 2 which extends in the region of the pliers head 4 so that a fixed actuation element 9 is built. Instead, the actuation element 10 is a movable actuation element 10 in the form of a pivot ring 11 which can be pivoted relative to the fixed actuation element 9 about a workpiece axis or die axis 13 defined by dies 12. Here the die axis 13 has an orientation perpendicular to the plane of illustration according to FIG. 1. The dies 12 are pivotable about axes which have an orientation parallel to the die axis 13 and which are supported by bearing bolts 14 which are held at the actuation element 9 or the cover plate 2. The bearing bolts 14 accordingly build guidances 15 for the dies 12. At the radial inner side in the region of grooves the pivot ring 11 forms actuation surfaces 16 at which counter-actuation surfaces 17 of the dies 12 contact so that a pivoting of the pivot ring 11 about the pivot axis 13 results in a pivoting movement of the dies 12 around the bearing bolts 14. The pivoting movement of the dies 12 again has the consequence that a die contour 18 changes its size. Here, the die contour is defined by the dies 12 and closed in circumferential direction around the die axis 13 under the build-up of a minimal gap between the adjacent dies 12. For the shown embodiment the die contour 18 is hexagonal in a first approximation independent from the size of the same.

The spring element 7 is built by an integral protrusion of the pivot ring 11 which extends in circumferential direction around the pivot axis 13 with the shape of an arc of a circle or here a spiral form. For the shown embodiment the circumferential angle is approximately 360°. The spring base 19 building the connecting region with the pivot ring 11 as well as the outer spring base 20 of the spring element 7 are approximately located in a 4 o'clock position with respect to the die axis 13 for the illustration according to FIG. 1 wherein the fixed hand lever 3 has a horizontal orientation. The spring base 20 is pivotably liked, here by a bearing bolt 21 at the movable hand lever 5. A roller 23 is supported for being rotated at the movable hand lever 5, here by a bearing bolt 22. The roller 23 contacts a curved track 24 of a guiding part 25. In the present case, by the curved track 24 the guiding part 25 only guides the roller 23 on one side. However, for another embodiment it is also possible that the roller 23 is accommodated between two curved tracks which might be the case with some play or without any play. The guiding part 25 is rigidly fixed to the fixed hand lever 3, here by bearing bolts 26, 27. By the bearing bolt 22 also a toothed latching lever 28 is supported for being pivoted. The toothed latching lever 28 is built with lever parts 29, 30. In the outer end region the lever part 29 forms a toothing 31 for latching. The lever part 30 comprises an elongated hole 32 having an orientation radially to the bearing bolt 22. The bearing bolt 27 extends through the elongated hole 32.

The drive mechanism 6 is formed by a toggle lever mechanism 33. The toggle lever mechanism 33 comprises a toggle lever 34 which corresponds to the connection between the contact point of the roller 23 with the curved track 24 and a second toggle lever 35 which corresponds to the connection between the bearing axes defined by the bearing bolts 21, 22. A toggle lever angle 36 is built between the toggle levers 34, 35.

Figure 2:
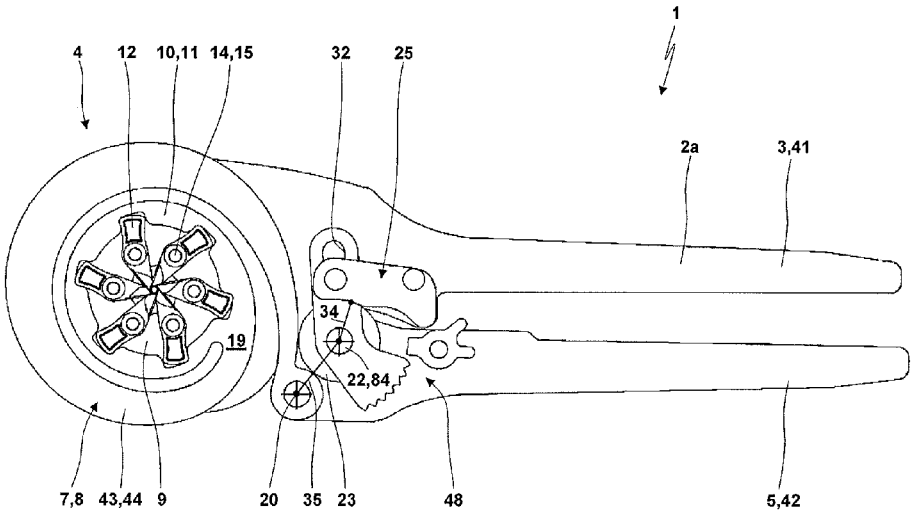

During the working stroke of the crimping pliers 1 from the open position according to FIG. 1 to the closed position according to FIG. 2, the movement of the hand levers 3, 5 in a first part of the stroke with neglectable crimping forces and with a support of the roller 23 at the curved track 24 of the guiding part 25 leads to the result that the bearing bolt 21 and therewith also the spring base 20 of the spring element 7 move in circumferential direction 37 around the die axis 13. Due to the neglectable crimping forces, there is no elastic deformation of the spring element 7. Accordingly, there is a corresponding pivoting movement of the pivot ring 19 which again coincides with a pivoting movement of the dies 12 and a reduction of the cross-sectional area of the die contour 18. Due to the fact that the contact point of the roller 13 with the curved track 24 of the guiding part 25 is not fixed, the roller 23 is able to roll along the curved track 24 during this part of the stroke. Dependent on the rolling movement of the roller 23 and on the geometry of the curved track 24, a changed toggle lever angle 36 results. This complex kinematic is superimposed by an increased elastic deformation of the spring element 7 with an increase of the crimping forces in the region of the die during closing movement. This shall be illustrated on the basis of a theoretical limit case for which it is assumed that the workpiece after a first part of the stroke (which might e.g. be formed by an empty stroke) and after a second part of the stroke (by which the workpiece is crimped with a plastic deformation of the same) the workpiece is ideally rigid in the last third part of the stroke. When reaching the ideally rigid state of the workpiece, the position of the dies 12 and the pivot ring 11 and accordingly also of the spring base 19 is also fixed. However, a further closing movement of the hand levers 3, 5 is possible in the third part of the stroke because with the further actuation of the hand levers 3, 5 the spring element 7 is elastically deformed. On the one hand side, the spring base 20 is deformed in circumferential direction 37. It is also possible that the spring base 20 is deformed in radial direction 38 of the die axis 13. Accordingly, despite of the rigid workpiece and fixed dies 12, fixed pivot ring 11 and fixed spring base 19, a rolling movement of the roller 23 along the curved track 24 takes place with the transfer of the hand levers 3, 5 into the closed state. For realistic stiffnesses of the workpiece there is a superposition of a plastic deformation of the workpiece (which becomes smaller with increasing crimping force) with an elastic deformation of the spring element 7, wherein the percentage of the elastic deformation of the spring element 7 relative to the plastic deformation of the workpiece becomes larger and larger with increasing crimping force. Accordingly, in practice in some cases there is a superposition of the second part of the stroke and the third part of the stroke.

Dependent on the cross-sectional area of the workpiece to be crimped, the position of the different parts of the stroke over the working stroke of the crimping pliers 1 changes:

- For a large workpiece an empty stroke building the first part of the stroke (e.g. between 0% and 15% of the working stroke) is very short. A plastic deformation of the workpiece takes place in a second part of the stroke, e.g. already at the beginning of the working stroke (e.g. between 15% and 60% of the working stroke), whereas a larger third part of the stroke (e.g. between 60% and 100% of the working stroke) follows in which primarily the spring element 7 is deformed.
- For a smaller workpiece an empty stroke building the first part of the stroke (e.g. between 0% and 30% of the working stroke) is longer. A plastic deformation of the workpiece follows in a second part of the stroke in a later part of the working stroke (e.g. between 30% and 80% of the working stroke), whereas a smaller third part of the stroke (e.g. between 80% and 100% of the working stroke) or even no third part of the stroke follows wherein primarily the spring element 7 is deformed.

At the same time with the pivoting movement of the hand levers 3, 5 towards each other, the toothed latching lever 28 is pivoted. During the pivoting movement of the toothed latching lever 28 a latching nose 39 of a latching pawl 40 which is also mounted for a pivoting movement at the hand lever 5 under the bias of a spring 93 slides ratchet-like along the toothing 31 for latching. If the hand forces applied to the hand levers 3, 5 are temporarily reduced or completely removed, the engagement of the latching nose 39 into the toothing 31 for latching blocks the opening movement of the hand levers 3, 5 and therewith also an opening movement of the dies 12. Only if the hand levers 3, 5 have completely reached the closed state, the latching nose 39 has completely passed the toothing 31 for latching so that the latching pawl 40 is able to turn over and to slide in a ratchet-like fashion during an opening movement of the hand levers 3, 5 back into its starting position (which by use of the toothing 31 for latching is only possible when having completely passed the toothing 31 for latching). A forced locking unit 48 is built with the toothed latching lever 28 and the latching pawl 40 biased by the spring 39.

For the general design of crimping pliers 1 with a pivot ring 11 and the provision of a common pivoting movement of here six dies 12 by a relative rotation of the actuation elements 9, 10, reference is made to the prior art, in particular EP 0 732 779 B1 and DE 10 140 270 B4 and DE 10 2005 003 615 B3. In the present case, the hand levers 3, 5 build drive elements 41, 42 upon which the manual actuation forces are applied. It will be understood that it is also possible that the drive elements 41, 42 are biased by forces of an actuator as an electrical drive.

Here, the spring element 7 is built by a type of bending beam 43. In the region of the spring base 20 force components in circumferential direction 37 and/or in radial direction 38 are introduced into the bending beam 43. These force components result in the bias of the bending beam 43 around a bending axis which has an orientation perpendicular to the plane of illustration according to FIG. 1. Here, generally also the use of a bias of the bending beam 43 by a pressing force resulting in a buckling is possible. However, preferably the bending beam 43 is biased by a pulling force in circumferential direction 37. For the shown embodiment the bending beam 43 is built by a spiral spring or a spring 44 having the shape of an arc of a circle extending in the plane of illustration according to FIG. 1. Here, the spiral spring or spring with the shape of an arc of a circle extends in circumferential direction 37 around the die axis 13.

The bending beam 43 comprises a neutral fiber or longitudinal axis 45 which here has the shape of an arc of a circle or a spiral shape. The bending stiffness changes along the neutral fiber or longitudinal axis 45, in particular due to a change of the geometric moment of inertia. For the shown embodiment the design of the size of the cross-section of the bending beam 43 which determines the geometric moment of inertia is symmetrical to a symmetry axis which runs through the die axis 13 and the spring base 20. In the same way the heights and the cross-sectional area of the spring element 7 is maximal in a cross-section 47 which is located in the middle in circumferential direction between the spring bases 19, 20.

Figure 3:
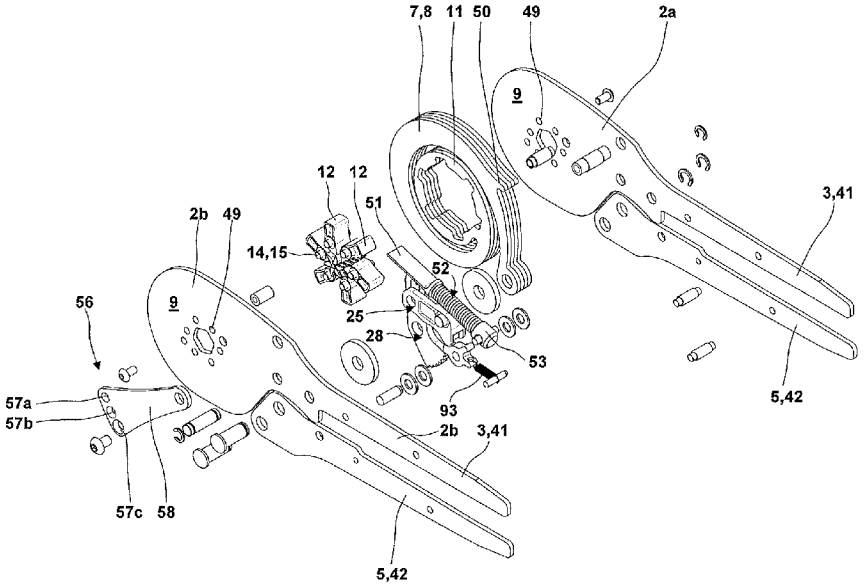

In the explodes view of FIG. 3 it can be seen that the crimping pliers are built with two cover plates 2*a*, 2*b*. The two cover plates 2*a*, 2*b* build the fixed hand lever 3. On the other hand, the cover plates 2*a*, 2*b* build a kind of housing of the pliers head 4. Between the cover plates 2*a*, 2*b* the movable parts, namely the spring element 7, the pivot ring 11 and the dies 12 are accommodated. On the other hand, the bearing bolts 14 for the dies 12 are accommodated in bores 49 of the cover plates 2*a*, 2*b*.

Furthermore, in FIG. 3 it can be seen that the spring element 7 and the pivot ring 11 are formed by a plate design, here with four plates. The single plates for the pivot ring 11 and the spring element 7 are built as integral parts.

Differing from the embodiment shown in FIGS. 1 and 2, according to FIG. 3 the spring element optionally comprises a protrusion 50 at its outer side. A spring base 51 or a plug or stem coupled with any such spring base of another spring 52 is supported at the protrusion 52. The other spring base 53 of the other spring 52 is supported at the cover plates 2*a*, 2*b* or at the movable hand lever 5. By the other spring 52 it is possible to influence the force conditions at the crimping pliers 1 additionally to the spring element 7. Accordingly, the other spring 52 can be used for manipulating the dependency of the produced crimping force from the pivot angles of the hand levers and from the actuating force applied to the hand levers. It is also possible that by the other spring 52 the contact force of the roller 23 with the curved track 24 of the guiding part 25 is increased or provided.

Figure 4:
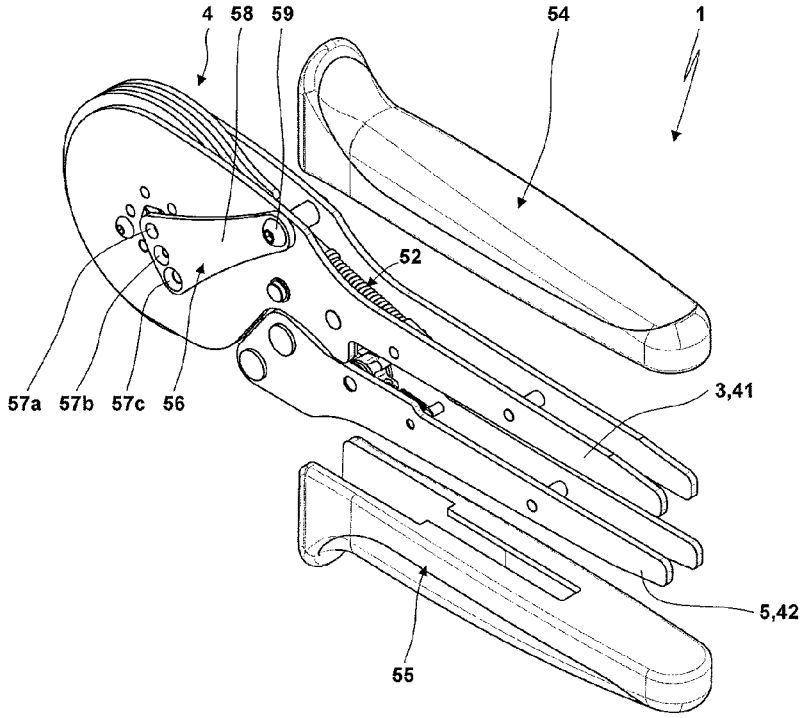

FIG. 4 shows the assembled basic components of the crimping pliers 1 according to FIG. 3 before being assembled with handles 54, 55 associated with the two hand levers 3, 5.

According to FIGS. 3 and 4, it is possible that the crimping pliers 1 comprises a positioning device 56. For the shown embodiment the positioning device 56 comprises three alternative accommodations 57*a*, 57*b*, 57*c* for workpieces with differing cross-sectional areas. The positioning device 56 can be brought into different operating positions in which a respective one of the accommodations 57*a* (57*b*, 57*c*) is arranged with an orientation coaxial to the die axis. 13. For the shown embodiment the positioning device 65 is built with a positioning strut or a positioning disc 58 which is supported for being pivoted at the cover plates 2, here by a bearing bolt 50. The positioning strut or positioning disc 58 directly and slidingly contacts the outer side of the cover plate 2*b*.

Figure 5:
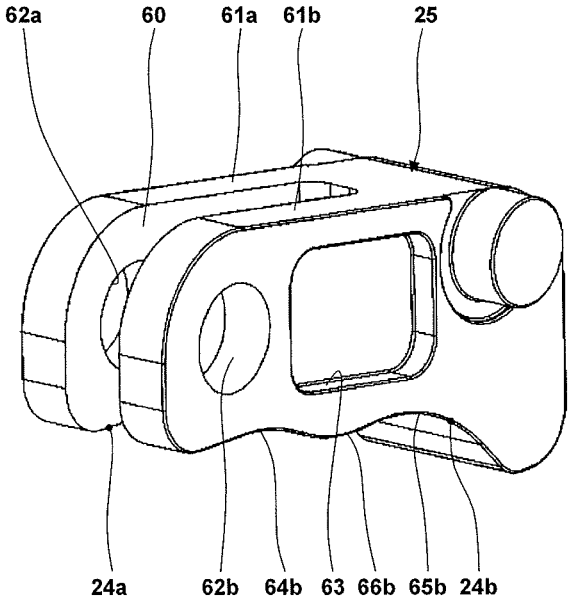

As shown in FIG. 5, the guiding part 25 has a fork-like shape with the formation of a slit 60 between two legs 61*a*, 61*b*. Under the provision of a relative pivoting movement the toothed latching lever 28 extends through the slit 60 of the guiding part 25 (cp. also FIG. 3). In the outer end region the legs 61*a*, 61*b* each have a bore 62*a*, 62*b* through which the bearing bolts 27 extend in the assembled state. For weight reasons the legs 61*a*, 61*b* might comprise recesses 63.

In FIG. 5 it can be seen that for the shown embodiment the two legs 61*a*, 61*b* form two parallel curved tracks 24*a*, 24*b* at which the two roller 23*a*, 23*b* on both sides of the toothed latching lever 28 roll along. Furthermore, it can be seen that for the shown embodiment the curved tracks 24*a*, 24*b* comprise two concave partial regions 64, 65 between which a convex partial region 66 is located. Here, the curved track 24 has a larger inclination in the concave partial region 65 which is run through at the beginning of the working stroke than in the other partial regions of the curved track 24.

Figure 6:
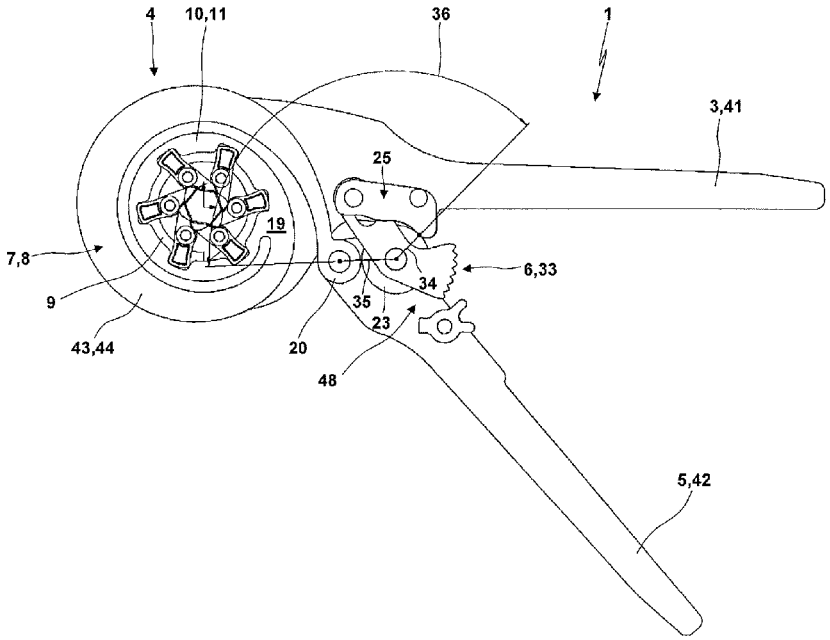
Figure 7:
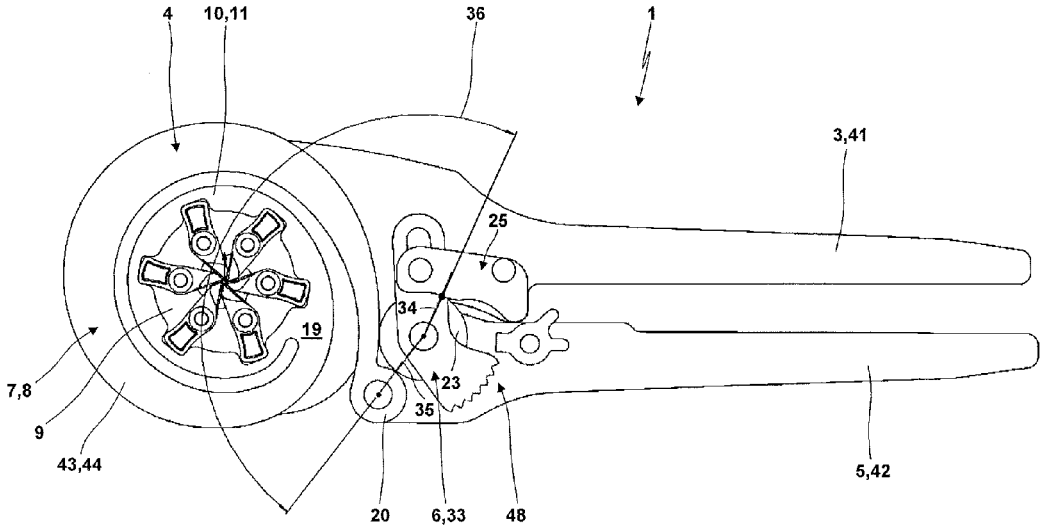

By a choice of a suitable shape of the curved track 24 it can be provided that the toggle lever angle 36 of the toggle lever mechanism 33 is comparatively large during the whole working stroke. According to FIG. 6, at the beginning of the working stroke the toggle lever angle 36 is approximately 135°, whereas the toggle lever angle 36 is in the range between 160° to 180° at the end of the working stroke according to FIG. 7. Preferably, the toggle lever angle 36 is during the whole working stroke always between 130° and the stretched angle of 180° which is due to

- a suitable shape of the curved track 24,
- a choice of the characteristic and geometry of the spring element as well as
- the dimensioning of the drive mechanism 6.

Figure 8:
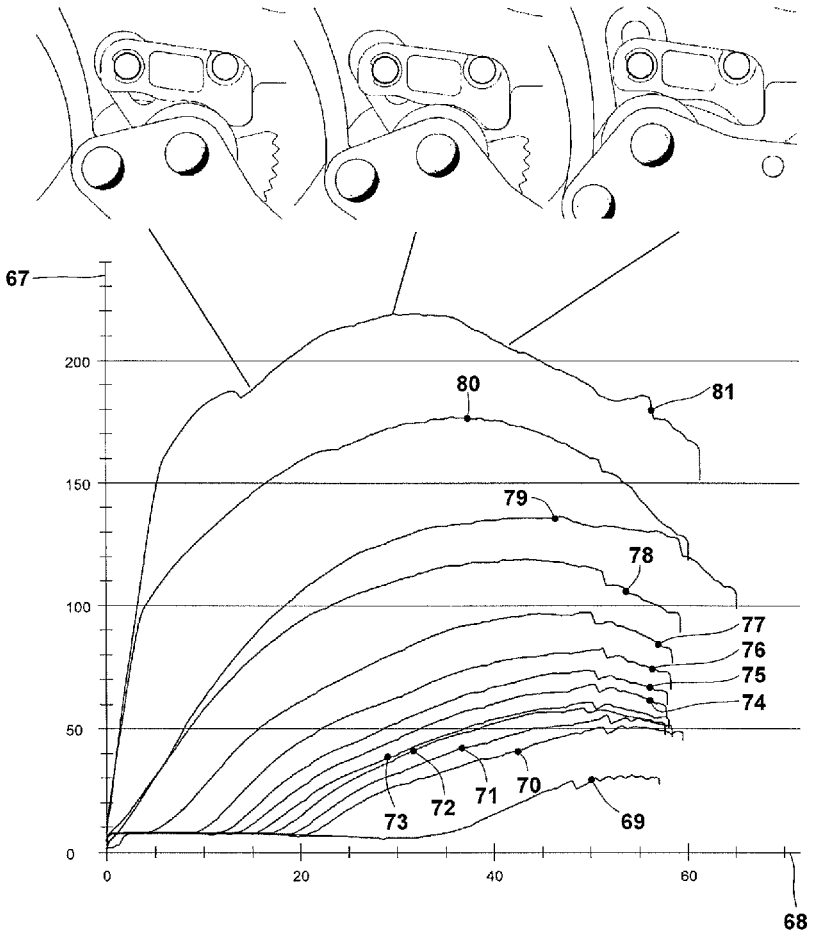

FIG. 8 shows the hand forces 67 being required as a function of the actuation displacement 68 of the movable hand lever 5. Here, the curves 69 to 81 show the curves for the hand force for differing cross-sectional areas of the workpieces, namely 0.08 $mm^2$ (69), 0.14 $mm^2$ (70), 0.25 $mm^2$ (71), 0.35 $mm^2$ (72), 0.5 $mm^2$ (73), 0.75 $mm^2$ (74), 1.0 $mm^2$ (75), 1.5 $mm^2$ (76) 2.5 $mm^2$ (77), 4 $mm^2$ (78), 6 $mm^2$ (79), 10 $mm^2$ (80) and 16 mm (81). Here it can be seen that for smaller workpieces at first the starting first part of the stroke is run through with neglectable crimping forces, whereas the actual hand forces are only applied at the end of the working stroke. With increasing size of the workpiece the rising of the curves 69 to 81 is shifted towards smaller actuating displacements. In FIG. 8 it can be seen that a crimping of all of the mentioned workpieces is possible with one and the same crimping pliers 1 by controllable hand forces which are preferably smaller than 300 N.

Figure 9:
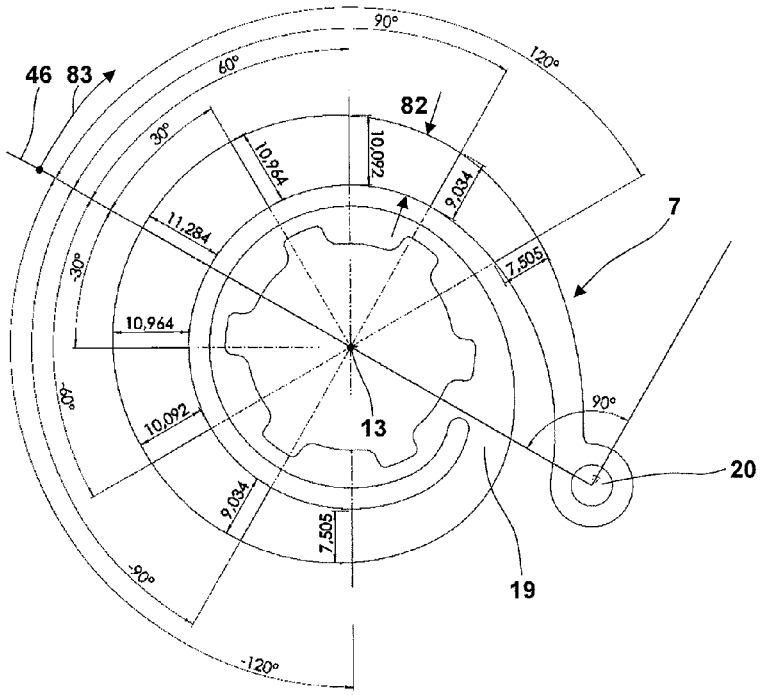
Figure 10:
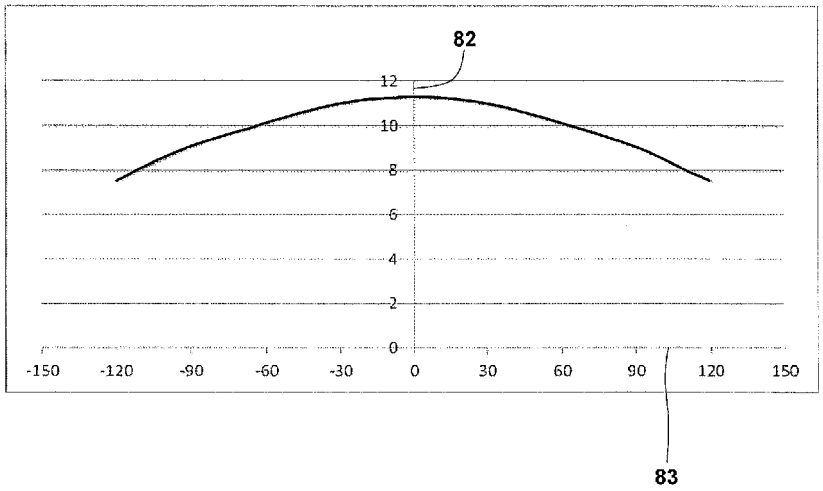

FIG. 9 shows an example for the choice of the dimensions of the spring element 7. It can be seen that the spring element spirally extends around the die axis 13 with an angle in circumferential direction of approximately 360°. The effective height 82 of the spring element 7 for influencing the geometric moment of inertia is symmetrical to the symmetry axis 46 or increases from both spring bases 19, 29 in the same extent to the middle of the spring element 7 in circumferential direction between the two spring bases 19, 20. Whereas in FIG. 9 only discrete values of the heights 82 of the spring element 7 are given, FIG. 10 shows the dependency of the heights 82 from the circumferential angle 83 starting from the location in the middle between the two spring bases 19, 20.

Figure 11:
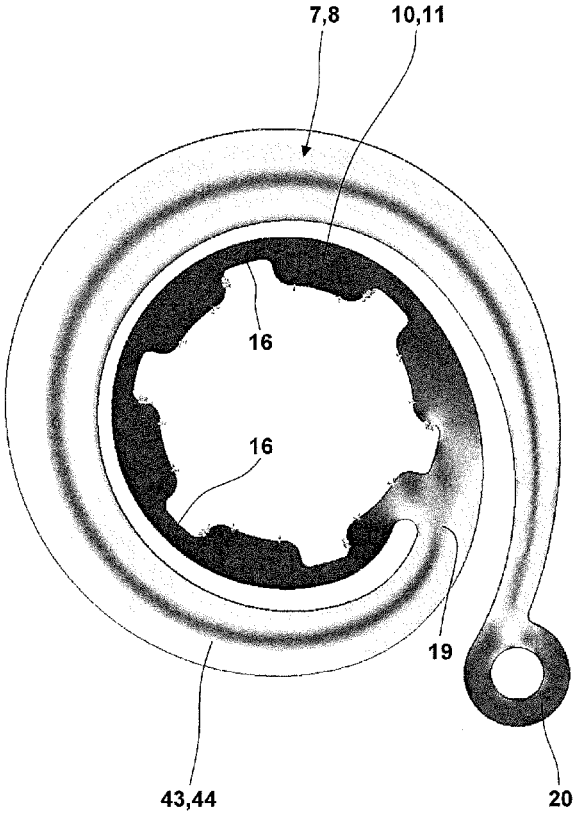

FIG. 11 shows the distribution of the tension in the spring element 7, wherein here for the same tension the same grey scale has been used. By means of the symmetric design of the spring element 7 and the choice of the heights 82 according to FIG. 10, it can be provided that the maximum of the tension in the spring element 7 remains constant along the circumference or along the longitudinal axis 45.

Figure 12:
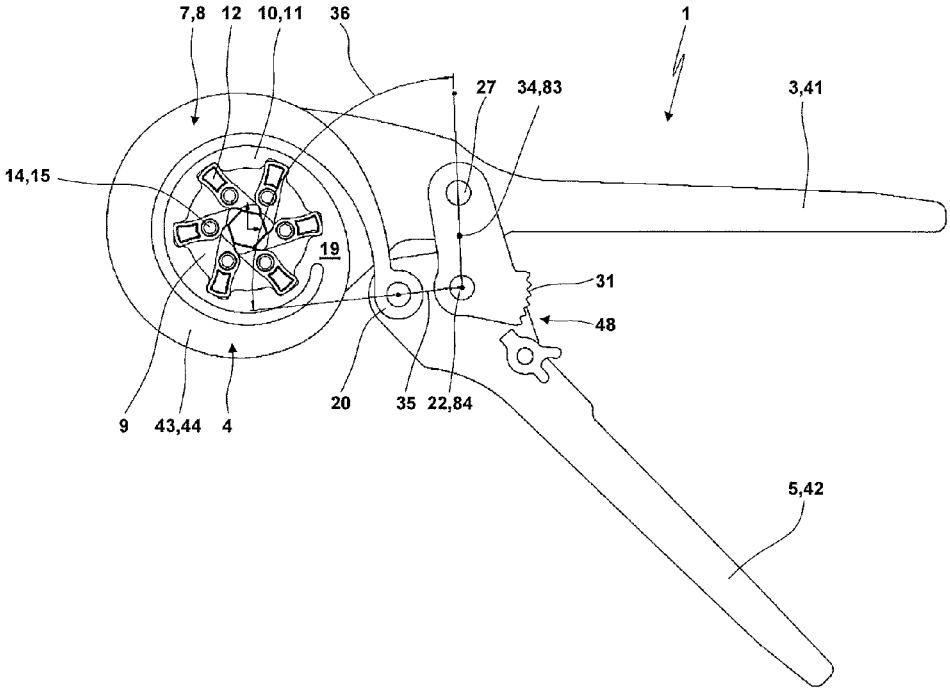
Figure 13:
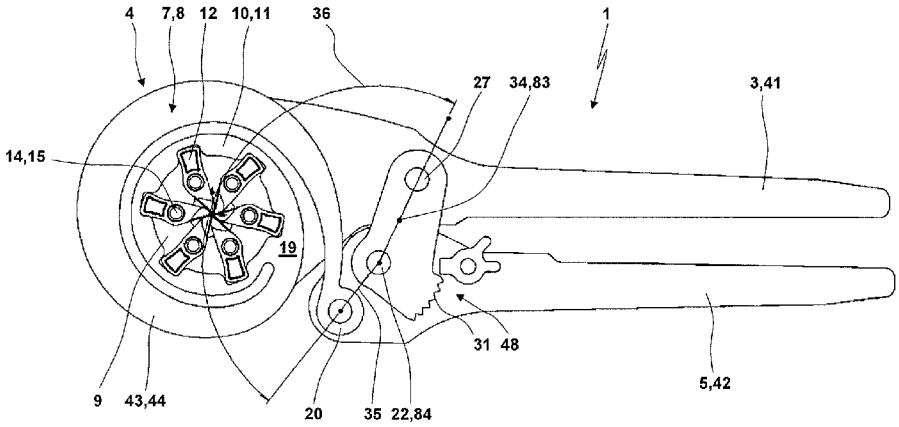

For the embodiment shown in FIGS. 12 and 13 the toggle lever mechanism 33 is not built with a roller 23 and a curved track 24 of a guiding part 25. Instead, here (with a design of the toggle lever 35 corresponding to the embodiment explained above) the toggle lever 34 is built with a pressure lever 83. In the region of the bearing bolt 22 the pressure lever 83 builds the toggle lever joint 84. In one end region the pressure lever 83 is linked by a bearing bolt 27 to the cover plate 2. In the other end region the pressure lever 83 directly builds the toothing 31 for latching of the forced locking unit 48. Due to the use of the pressure lever 83 instead of the principle roller 23/curved track 24 in the open position according to FIG. 12 the toggle lever angle 36 is approximately 90°. Starting from the open position it is not possible to immediately produce large crimping forces whereas in the closed state according to FIG. 13 a toggle lever angle of approximately 160°, 165° or 170° is reached. For such a toggle lever angle 36 at the end of the working stroke it is possible to produce large crimping forces. Between the open state and the closed state the toggle lever angle 36 increases continuously when running through the working stroke (whereas for the use of the principle roller 23/curved track 24 according to FIGS. 1 to 11 dependent from the chosen contour of the curved track 24 it might also be possible that the toggle lever angle 24 at least in a partial region decreases or remains constant when running through the working stroke). This illustrates that the use of the principle roller 23/curved track 24 with a suitable design of the curved track 24 might be advantageous if it is of interest that dependent on the size of the workpiece to be crimped the real crimping should take place at the beginning of the working stroke or at the end of the working stroke. Nevertheless, the inventive design is also usable for crimping pliers without the principle roller 23/curved track 24.

Figure 14:
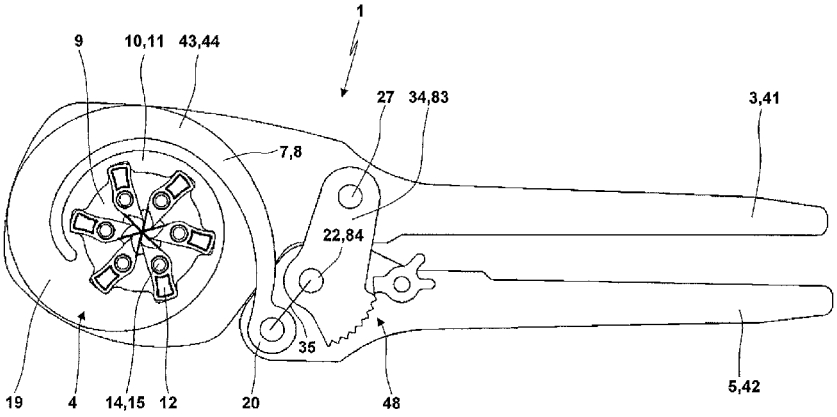
FIGS. 14 to 21 show other embodiments of the crimping pliers.

FIG. 14 shows another embodiment of crimping pliers 1, wherein according to the embodiment shown in FIGS. 12 and 13 a pressure lever 83 without the principle roller/curved track is used. However, here the spring element 7 (which might also be built by a spiral spring or a spring 44 in the shape of an arc of a circle) extends between the spring bases 19, 20 along the circumference around the die axis 13 not with an angle of approximately 360° but only with a circumferential angle of approximately 240° without the inventive base principle being left.

Figure 15:
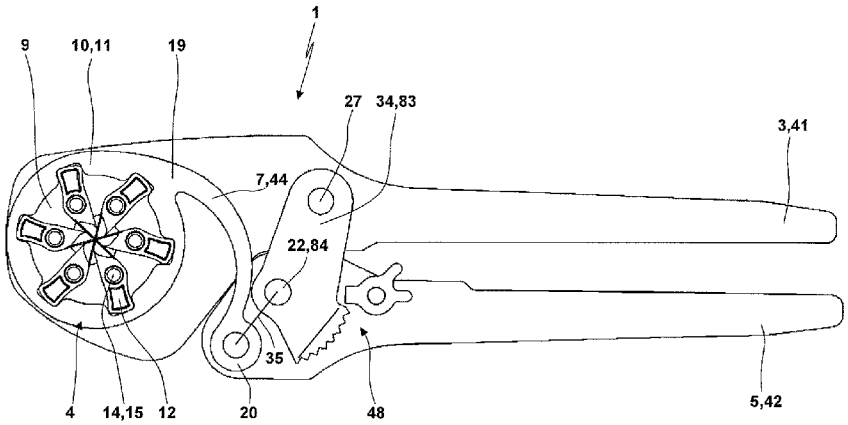

FIG. 15 shows another embodiment, wherein a spring 44 having the shape of an arc of a circle extends between the spring bases 19, 20 only along a circumferential angle of approximately 90°. Furthermore, the spring 44 having the shape of an arc of a circle here does not only have an orientation in circumferential direction around the die axis 13 so that in some cases a different bias of the spring 44 results. Said in simple words, in this case the spring 44 having the shape of an arc of a circle might be understood as a curved elastic "strut" which tangentially biases the pivot ring 11.

Figure 16:
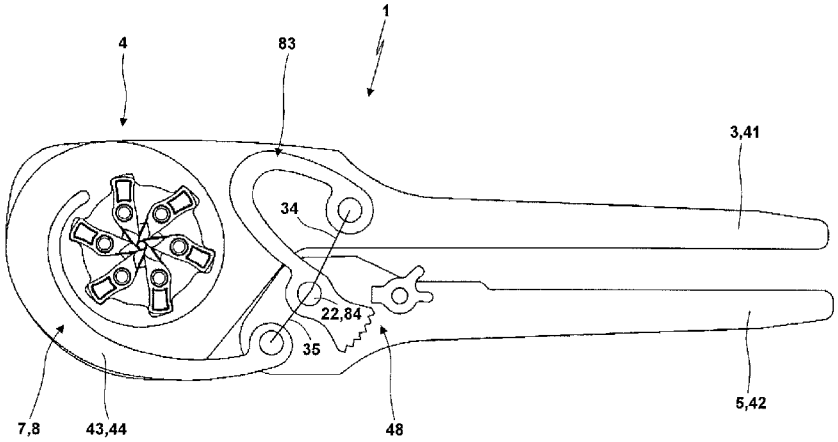

For the embodiment shown in FIG. 16 the spring element for the spiral spring or spring 44 having the shape of an arc of a circle extends over a circumferential angle of approximately 180°. Also here, instead of the principle roller 23/curved track 24 an embodiment with a pressure lever 83 is used. However, here the pressure lever 83 is not rigid but intentionally elastic so that this design builds an integration of the measures according to the non-published European patent application EP 14 154 206.8 into the crimping pliers. Also in this case the pressure lever 83 in one end region forms the toothing 31 for latching. Between the toggle lever joint 84 and the linking point of the pressure lever 83 at the cover plates 2 in a rough approximation the pressure lever has a V-shape or the pressure lever is curved or comprises the shape of a bow having an angle of the bow in the region of 150° to 180°.

Figure 17:
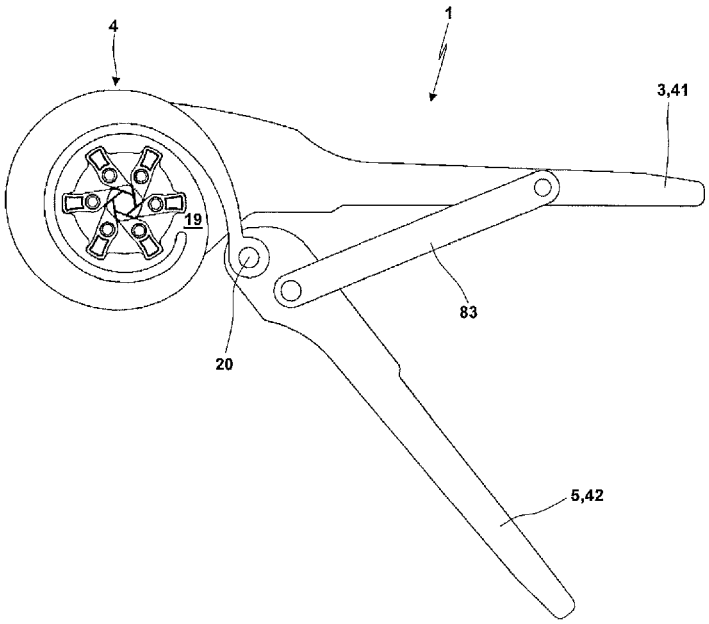

FIG. 17 shows another embodiment of the inventive crimping pliers 1 with a pressure lever 83 which here does not comprise a toothing 31 for latching and comprises an increased extension with a direct linking of the pressure lever 83 to the two hand levers 3, 5.

Figure 18:
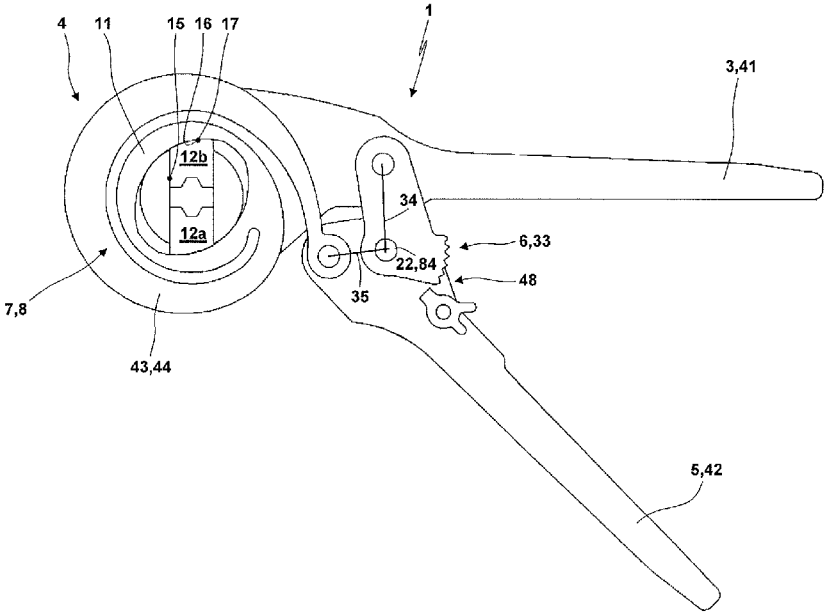
Figure 19:
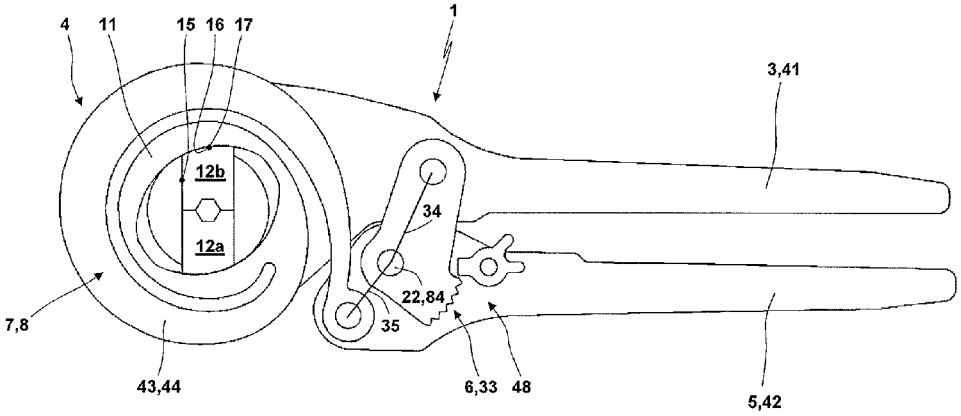

The embodiment according to FIG. 18 generally corresponds to the embodiment according to FIG. 12. However, here the movement of the actuation element 10 or pivot ring 12 is transferred to the dies 12 in a different way: In this case only two opposing dies 12*a*, 12*b* are provided. Also here the dies 12*a*, 12*b* are guided by guidances 15, wherein the guidance is not provided for a pivoting movement of the dies 12*a*, 12*b* but for a translational movement of the dies 12*a*, 12*b* towards each other and away from each other. The movement of the dies 12*a*, 12*b* along the degrees of freedom provided by the guidances 15 is also here caused by a contact of the actuation surfaces 16 of the pivot ring 11 with counter actuation surfaces 17 of the dies 12*a*, 12*b*. Whereas in FIG. 18 the crimping pliers 1 are shown in an open position, FIG. 19 shows the closed position of the crimping pliers 1.

Figure 20:
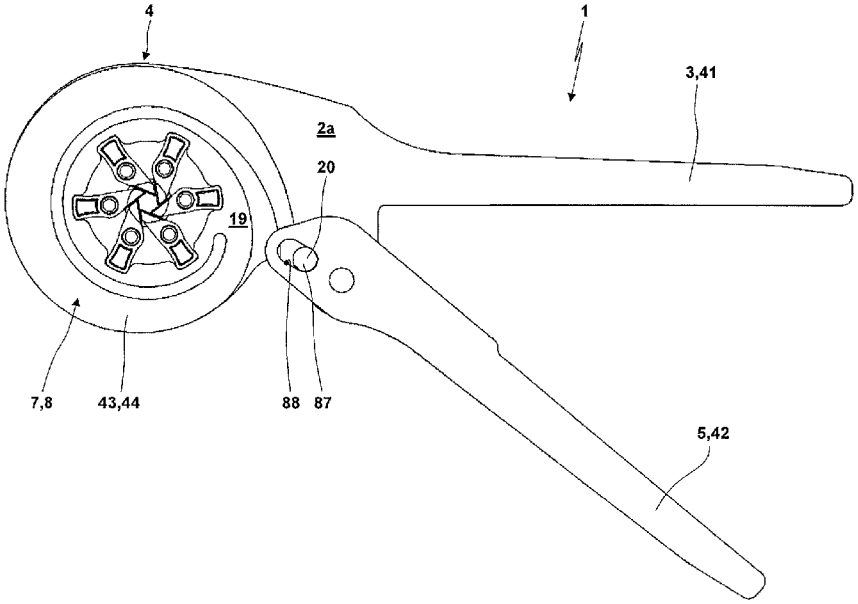

FIG. 20 shows an embodiment of a crimping pliers 1 without the use of a toggle lever mechanism 33. Instead, here the movable hand lever 5 is mounted for being pivoted directly at the cover plate 2 and so at the fixed hand lever 3. The spring base 20 of the spring element 7 is directly linked at an end region of the hand lever 5 protruding across the linking point of the hand lever 5 to the hand lever 3. This is here accomplished by a bearing bolt 87 of the spring element 7 which is accommodated in an elongated hole 88 of the hand lever 5.

Figure 21:
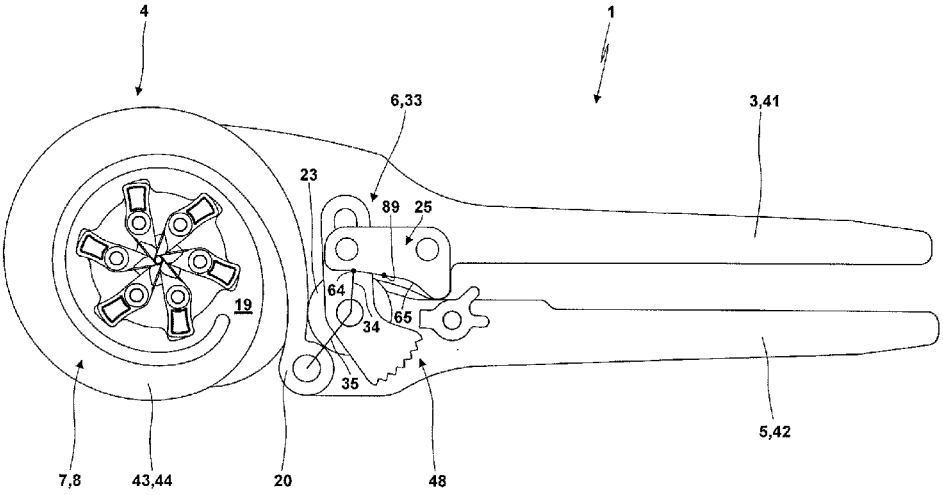

FIG. 21 shows another embodiment of the crimping pliers 1 which generally corresponds to the embodiment shown in FIGS. 1 to 11. However, here the contour of the curved track 24 has been chosen such that the contour only comprises concave partial regions 64, 65 which are connected with each other by a straight partial region 89.

Figure 22:
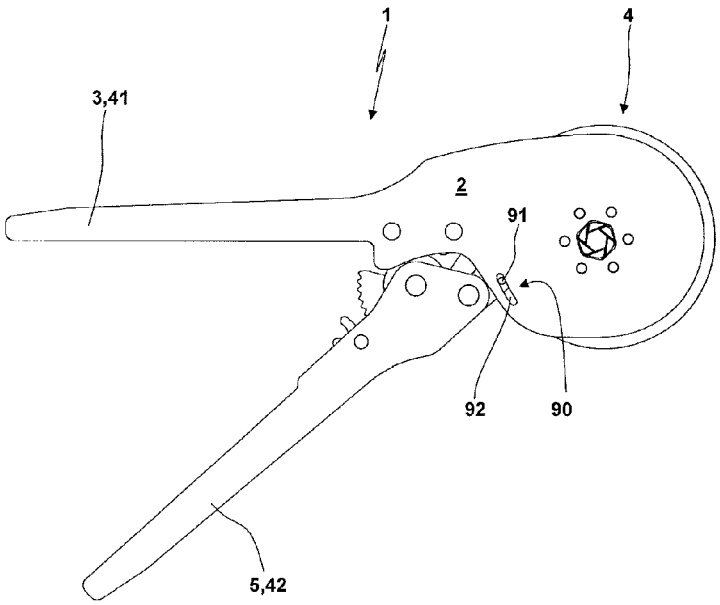
FIGS. 22 and 23 show another embodiment of the crimping pliers with an additional guidance of the spring element.
Figure 23:
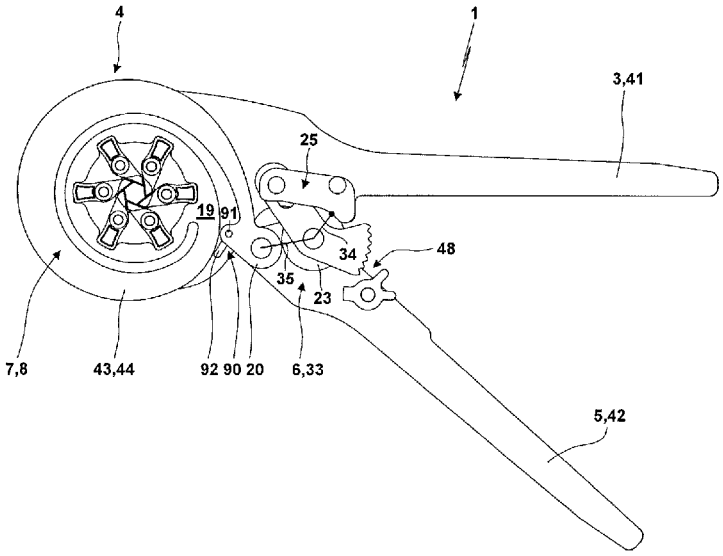

FIGS. 22 and 23 show another embodiment of crimping pliers, wherein FIG. 22 shows the crimping pliers in the open position with assembled cover plate and FIG. 23 shows the crimping pliers also in the open position but with disassembled cover plate. This embodiment generally corresponds to the embodiment of the crimping pliers 1 according to FIGS. 1 to 11 or FIG. 21. However, here the spring element 7 is guided in an additional guidance 90. For the shown embodiment, the guidance is provided in the region of the spring base 20. The guidance 90 is built by a guiding pin 91 held by the spring element 7. The guiding pin 91 is guided in a guiding groove or an elongated hole 92 of the cover plates 2. Preferably, the elongated hole 92 extends in circumferential direction around the pivot axis 13.

For the shown embodiment the guiding part 25 is mounted to the fixed hand lever 3, whereas the roller 23 is mounted for being pivoted at the movable hand lever 5. However, it is also possible that the guiding part 25 is fixedly mounted to the movable hand lever 5, whereas the roller 23 is mounted for being rotated at the fixed hand lever 3.

It is possible that within the frame of the invention the same base construction is used for crimping pliers actuated by hand and for crimping pliers actuated by an external force. However, in this case hand levers are used as the drive elements for the manually actuated crimping pliers, whereas for the crimping pliers actuated by an external force instead of the hand levers drive elements linked with an actuator will be used. To mention a simple non-limiting example, for crimping pliers actuated by an external force it is also possible that the fixed (hand) lever is shortened and supported at a fixed counter bearing, whereas a crank plug, a stem or plug or the like of an actuator is linked to the movable (in some cases also shortened) (hand) lever. In some cases crimping pliers being actuated by an external force do not comprise a forced locking unit.

Many variations and modifications may be made to the preferred embodiments of the invention without departing substantially from the spirit and principles of the invention. All such modifications and variations are intended to be included herein within the scope of the present invention, as defined by the following claims.

I claim:

1. Crimping pliers for crimping a workpiece comprising:

a) two drive elements, comprising a fixed hand lever and a movable hand lever, b) a pliers head comprising a first actuation element and a second actuation element which are connected by a drive mechanism and a spring element to the drive elements, c) at least two dies for crimping the workpiece, d) two spring bases, wherein d) the first actuation element comprises guidances, wherein each said guidance guides the associated die, the second actuation element comprises actuation surfaces for the at least two dies and a relative movement between the first and second actuation element results in a movement of the at least two dies relative to the guidances which is caused by the contact of the acuation surfaces with the at least two dies such that the at least two dies are actuated for crimping the workpiece between the at least two dies, e) the spring element comprises a force-displacement-compensation element and f) the spring element is arranged in the pliers head and directly linked with one of the spring bases to the movable hand lever and with the other of the spring bases to the second actuation element.

2. Crimping pliers of claim 1, wherein the spring element comprises a bending beam.

3. Crimping pliers of claim 2, wherein the spring element comprises a plate design.

4. Crimping pliers of claim 1, wherein the spring element extends in a circumferential direction around a die axis.

5. Crimping pliers of claim 4, wherein the spring element comprises a spring having the shape of an arc of a circle or a spiral spring.

6. Crimping pliers of claim 2, wherein the bending beam has a bending stiffness varying along its longitudinal axis.

7. Crimping pliers of claim 6, wherein the geometric moment of inertia of the bending beam increases from the one of the spring bases which is linked to the moveable hand lever to a cross-section of the bending beam located opposite the spring base in a circumferential direction.

8. Crimping pliers of claim 7, wherein the geometric moment of inertia of the bending beam is symmetrical to a symmetry axis which runs approximately through the one of the spring bases which is linked to the moveable hand lever and through the cross-section of the bending beam located opposite the spring base in a circumferential direction.

9. Crimping pliers of claim 1, wherein a) the actuation elements are pivoted relative to each other around the die axis, b) the at least two dies are mounted for a pivoting movement relative to the guidances and c) the relative pivoting movement of the actuation elements results in a pivoting movement of the at least two dies relative to the guidances by the contact of the actuation surfaces with the at least two dies.

10. Crimping pliers of claim 1, wherein the drive mechanism comprises a toggle lever mechanism.

11. Crimping pliers of claim 10, wherein the toggle lever mechanism comprises a roller and a guiding part, wherein over the working stroke, the roller rolls along the guiding part.

12. Crimping pliers of claim 11, wherein a) the guiding part is mounted to the drive element at which one of the actuation elements is mounted and b) the roller is mounted for being rotated to the other drive element at which the spring element is linked which is connected to the other actuation element.

13. Crimping pliers of claim 11, further comprising a second spring element which provides a contact force of the roller at the guiding part.

14. Crimping pliers of claim 13, wherein one spring base of the second spring element biases the spring element.

15. Crimping pliers of claim 1, further comprising a forced locking unit.

16. Crimping pliers of claim 15, wherein the forced locking unit comprises a toothed latching lever a) which is rotatably mounted about a pivot axis of the roller and b) of which an end region opposing the toothing for latching is connected by an elongated hole to the drive element at which the mounting part is mounted.

17. Crimping pliers of claim 1, wherein by use of a) the force-displacement-compensation due to the force-displacement-compensation element and/or b) the movement of the roller along the curved track of the guiding part with a change of the dimensional and angular properties of the toggle lever mechanism, it is possible to crimp workpieces of different cross-sectional areas, wherein for two different workpieces crimped with the crimping pliers, the cross-sectional areas differ by at least a factor of 30.

18. Crimping pliers of claim 1, wherein the pliers head further comprises a positioning device for at least one workpiece.

19. Crimping pliers of claim 1, wherein the spring element is guided by a guidance.

20. Crimping pliers of claim 2, wherein the spring element extends in a circumferential direction around a die axis.

21. Crimping pliers of claim 3, wherein the spring element extends in a circumferential direction around a die axis.

22. Crimping pliers of claim 3, wherein the bending beam has a bending stiffness varying along its longitudinal axis.

23. Crimping pliers of claim 22, wherein the geometric moment of inertia of the bending beam increases from the spring base at which the bias by the drive mechanism is applied to a cross-section of the bending beam located opposite the spring base in a circumferential direction.

24. Crimping pliers of claim 23, wherein the geometric moment of inertia of the bending beam is symmetrical to a symmetry axis which runs approximately through the spring base at which the bias by the drive mechanism is provided and through the cross-section of the bending beam located opposite the spring base in a circumferential direction.

25. Crimping pliers of claim 12, further comprising a second spring element which provides a contact force of the roller at the guiding part.

26. Crimping pliers of claim 25, wherein one spring base of the second spring element biases the spring element.

* * * * *